US008172448B1

(12) United States Patent
Hudman et al.

(10) Patent No.: US 8,172,448 B1
(45) Date of Patent: May 8, 2012

(54) METHOD AND APPARATUS FOR ADAPTING ASPHALT DRYER/MIXER TO MINIMIZE ASPHALT BUILD-UP

(75) Inventors: Larry W. Hudman, Ooltewah, TN (US); J. Greg Renegar, Ooltewah, TN (US); Michael C. Varner, East Ridge, TN (US)

(73) Assignee: Astec, Inc., Chattanooga, TN (US)

( * ) Notice: Subject to any disclaimer, the term of this patent is extended or adjusted under 35 U.S.C. 154(b) by 492 days.

(21) Appl. No.: 12/584,309

(22) Filed: Sep. 3, 2009

(51) Int. Cl.
*B28C 5/46* (2006.01)

(52) U.S. Cl. ..... 366/2; 366/25; 366/348; 366/349; 366/607; 432/118

(58) Field of Classification Search ..... 366/2, 6–8, 366/22–25, 53–58, 147, 219–235, 348, 349, 366/607; 432/103–119; 34/135–137
See application file for complete search history.

(56) References Cited

U.S. PATENT DOCUMENTS 1,910,873 A * 5/1933 Zahn ..... 432/118
2,261,403 A * 11/1941 Newhouse ..... 432/118
2,319,985 A 5/1943 Genasci
2,332,724 A * 10/1943 Johnson ..... 432/118
3,211,461 A 10/1965 Elwick
3,229,985 A 1/1966 Yuenger et al.
3,281,134 A * 10/1966 Feiser, Jr. ..... 159/9.1
3,333,837 A * 8/1967 Bojner ..... 432/118
3,392,922 A 7/1968 Lindgren
3,414,199 A 12/1968 Ferris
3,526,394 A * 9/1970 Howell, Jr. ..... 366/147
3,544,092 A * 12/1970 Boron ..... 59/78
3,556,413 A 1/1971 Lindgren
3,610,473 A 10/1971 Hochstetler
3,640,473 A 2/1972 Webb et al.
3,715,884 A * 2/1973 Sanders ..... 59/78
3,738,797 A * 6/1973 Robinson et al. ..... 432/118
3,802,831 A * 4/1974 Woodward ..... 432/28
3,828,947 A 8/1974 Lepley
3,980,239 A 9/1976 Lee
4,002,491 A 1/1977 Esparza
4,014,643 A * 3/1977 Musha et al. ..... 432/118
4,060,587 A * 11/1977 Lewis ..... 423/210
4,108,088 A 8/1978 Burden, Jr.
4,172,701 A * 10/1979 Bernt ..... 432/118
4,244,687 A * 1/1981 Bernt et al. ..... 432/118
4,337,583 A 7/1982 Harris
4,341,514 A * 7/1982 Shanks ..... 432/3
4,451,004 A 5/1984 Ostergren et al.
4,561,594 A 12/1985 Kampman
5,083,382 A * 1/1992 Brashears ..... 34/135

(Continued)

*Primary Examiner* — Charles E Cooley
(74) *Attorney, Agent, or Firm* — Chambliss, Bahner & Stophel, P.C.

(57) ABSTRACT

A method and template are provided for modifying an asphalt dryer/mixer that includes an outer drum and an inner drum with a plurality of mixing paddles, the two drums forming an annular mixing chamber in which asphalt cement and aggregate materials are mixed. The template comprises a bracket marking portion that is adapted to locate one or more brackets on the inner drum and a paddle reference portion that is adapted to locate the bracket marking portion with respect to a mixing paddle. A mixing paddle to be referenced for locating a bracket is selected and the template is placed on the inner drum with the paddle reference portion referencing the selected mixing paddle. The template is used to mark the location of the bracket, the bracket is affixed to the outer surface of the inner drum at the bracket location marked; and an agitation strand is attached to the bracket.

22 Claims, 10 Drawing Sheets

U.S. PATENT DOCUMENTS 5,320,524 A * 6/1994 de Beus ..... 432/103
5,515,620 A * 5/1996 Butler ..... 34/137
6,177,052 B1 1/2001 Weichs et al.
6,422,925 B2 7/2002 Dill
6,726,351 B2 * 4/2004 Dillman ..... 366/57
2005/0073905 A1 * 4/2005 Montgomery et al. ..... 366/25
2006/0083104 A1 * 4/2006 Montgomery et al. ..... 366/25

* cited by examiner

METHOD AND APPARATUS FOR ADAPTING ASPHALT DRYER/MIXER TO MINIMIZE ASPHALT BUILD-UP

FIELD OF THE INVENTION

This invention relates generally to a method and apparatus for adapting an asphalt dryer/mixer comprising a rotating inner drum mounted within an outer stationary drum to minimize the build-up of asphalt cement and asphalt concrete on the outer surface of the inner drum. In the preferred embodiment of the invention, a template and method are provided for use in mounting a plurality of kiln chains to the outer surface of the inner drum.

BACKGROUND AND DESCRIPTION OF THE PRIOR ART

Asphalt concrete is a mixture of asphalt cement and aggregate materials of various sizes. Production facilities for making asphalt concrete to be used as a paving composition are well-known, and various such facilities may allow for batch production or continuous production. U.S. Pat. No. 4,867,572 of Brock et al. describes a type of continuous production plant known as a counter-flow dryer/mixer. This machine comprises an inclined inner drum mounted for rotation about its long axis. A non-rotating outer drum is disposed around the rotating inner drum so as to form an annular mixing chamber between the outside of the inner drum and the inside of the outer drum. Paddles are mounted on both the inner and outer surfaces of the inner drum. A burner is located at the lower end of the inner drum, and aggregate materials are introduced into the upper end of the inner drum. Because of the inclination and rotation of the inner drum, as well as the location of the paddles on the outer surface of the inner drum, aggregate materials that are introduced into the upper end of the inner drum are dried and heated as they are tumbled down towards the lower end and towards the source of the burner flame.

At the lower end of the inner drum, the dried and heated aggregate materials are discharged into the annular mixing chamber between the inner drum and the outer drum. Liquid asphalt cement is also introduced through an AC port into this annular mixing chamber, and continued rotation of the inner drum causes the asphalt cement to be thoroughly mixed with the heated and dried aggregate materials to produce an asphalt concrete mixture. The paddles on the outside of the inner drum assist in this mixing as the inner drum is rotated, and they also serve to direct the asphalt concrete mixture in the annular mixing chamber towards the upper end of the inner drum to an asphalt concrete discharge outlet.

Some embodiments of the counter-flow dryer/mixer include an inlet into the inner drum for recycled asphalt product ("RAP"). In these embodiments, RAP, which is also comprised of asphalt cement and aggregate materials, may be introduced into the inner drum where it will be heated, tumbled and dried with the aggregate materials therein. The RAP must be heated sufficiently to melt the asphalt cement therein so that the components of the RAP can be thoroughly intermixed with the virgin aggregate materials and the asphalt cement in the annular mixing chamber.

Because asphalt cement is an excellent binder of aggregate materials, and because the production of asphalt concrete in a counter-flow dryer/mixer is a dynamic process, it is common for some asphalt concrete, as well as asphalt cement and mixtures of asphalt cement and fine aggregate material used in the production process, to accumulate on the outer surface of the inner drum. Since the dryer/mixer is heated to a high temperature prior to beginning the production cycle, and since it remains hot for a time after production has ceased, accumulated asphaltic material will oxidize over time to form a hard build-up. As the inner drum expands and contracts upon heating and cooling during normal use, this oxidized material will crack and break loose from the outer surface of the inner drum. This loose material falls into the annular mixing chamber where it will contaminate subsequently produced asphalt concrete. When asphalt concrete that is contaminated with oxidized build-up material is spread with a paving machine, the oxidized material may be pulled by the paver screed through the newly laid mat of asphalt concrete, thereby damaging the surface of the asphalt mat. Any damage of this type must be quickly repaired by hand prior to compaction of the mat, thus resulting in delays in completing the paving project and unnecessarily exposing workers to the hot asphalt concrete. Furthermore, when build-up becomes a problem, the asphalt dryer/mixer must be taken out of production and partially disassembled so that the build-up material can be removed from the outer surface of the inner drum.

It is known that operating the asphalt dryer/mixer at a low tonnage rate increases the likelihood that (or the rate at which) oxidized material will build up on the outer surface of the inner drum. However, increasing the tonnage rate of the asphalt dryer/mixer to reduce the rate of build-up will also increase the rate of wear of the inner and outer drums, and the rate of wear of the paddles mounted on the inner and outer surfaces of the inner drum. It is also known to modify the tips of the paddles on the outer surface of the inner drum to slow the movement of asphalt mix through the annular mixing chamber and thereby mimic a high tonnage rate. However, such a modification requires much time and hand work and also involves the expense of the modified tips added.

It would be desirable if a method and apparatus could be provided that would allow for modifying the asphalt dryer/mixer in a relatively simple and inexpensive way to minimize the build-up of asphalt cement and asphalt concrete material on the outer surface of the inner drum.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The steps of any method described herein in connection with the preferred embodiments of the invention can be performed in any suitable order unless otherwise indicated herein, explicitly or by context. The use of any and all examples or exemplary language (e.g., "such as") herein is intended merely to better illuminate the invention and does not pose a limitation on the scope of the invention unless otherwise claimed. Nothing in the specification should be construed as indicating any non-claimed element as essential to the practice of the invention.

The following defined terms, and any other terms specifically defined herein, are to be given their broadest possible construction consistent with such definitions:

The terms "asphalt dryer/mixer", "dryer/mixer" and similar terms refer to an asphalt production machine that is adapted to heat and dry aggregate materials and mix such materials with asphalt cement, as well as other materials known to those having ordinary skill in the art to which the invention relates.

The terms "adapting an asphalt dryer/mixer", "modifying an asphalt dryer/mixer", "adapting the inner drum of a dryer/mixer", "modifying the inner drum of a dryer/mixer" and similar terms, when used in connection with the invention, refer to the use of the invention in original equipment manufacture, as well as in retrofitting existing equipment.

The term "aggregate materials" and similar terms refer to crushed stone and other particulate materials that are used in the production of asphalt concrete, such as, for example, crushed limestone and other types of crushed stone, shredded or comminuted mineral and cellulosic fibers, gravel, sand, lime and other particulate additives.

The terms "asphalt cement", "AC" and similar terms refer to a material that is used in combination with aggregate materials in the production of asphalt concrete. Asphalt cement acts as the binder for various aggregate materials in the production of asphalt concrete.

The terms "recycled asphalt product", "RAP" and similar terms refer to a comminuted or crushed product containing aggregate materials bound together by asphalt cement. RAP typically comprises crushed or comminuted recycled asphalt paving materials, crushed, shredded or comminuted shingles and other asphalt cement-containing products.

The term "asphalt concrete" and similar terms refer to a bituminous paving mixture that is produced, using asphalt cement and any of various aggregate materials, in an asphalt dryer/mixer or other asphalt concrete production plant. Asphalt concrete may be made with any of various aggregate materials, asphalt cement and RAP.

SUMMARY OF THE INVENTION

The invention comprises a method for modifying an asphalt dryer/mixer that includes a stationary outer drum having an inner surface and a rotatable inner drum having an outer surface with a plurality of mixing paddles mounted thereon, said inner drum being mounted within the outer drum so as to form an annular mixing chamber between the outer surface of the inner drum and the inner surface of the outer drum in which asphalt cement and aggregate materials are mixed. The method includes providing a template that is curved so as to overlie a portion of the outer surface of the inner drum. The template comprises a bracket marking portion that is adapted to locate one or more brackets on the outer surface of the inner drum, and a paddle reference portion that is adapted to locate the bracket marking portion with respect to a mixing paddle. The method also includes selecting a mixing paddle to be referenced for locating a bracket and placing the template on the outer surface of the inner drum with the paddle reference portion referencing the selected mixing paddle. The method further includes providing a bracket and an agitation strand that is adapted to be attached to the bracket. According to a practice of the method, the template is used to mark the location of the bracket, the bracket is affixed to the outer surface of the inner drum at the bracket location marked, and the agitation strand is attached to the bracket.

The invention also includes the template that is described herein for use in practicing the method.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
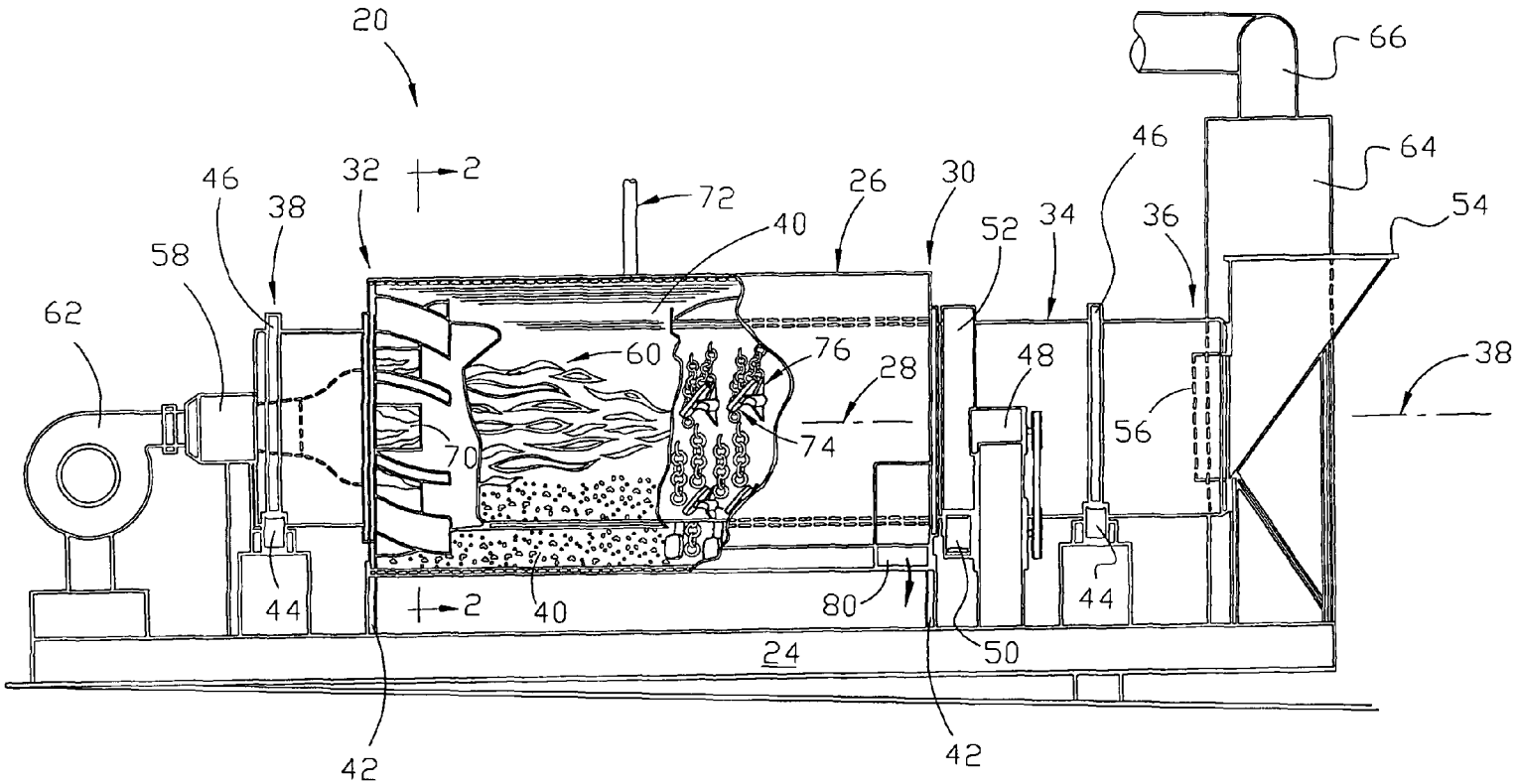
FIG. 1 is a partially cut-away side view of a first embodiment of an asphalt dryer/mixer that has been modified according to the present invention.
Figure 2:
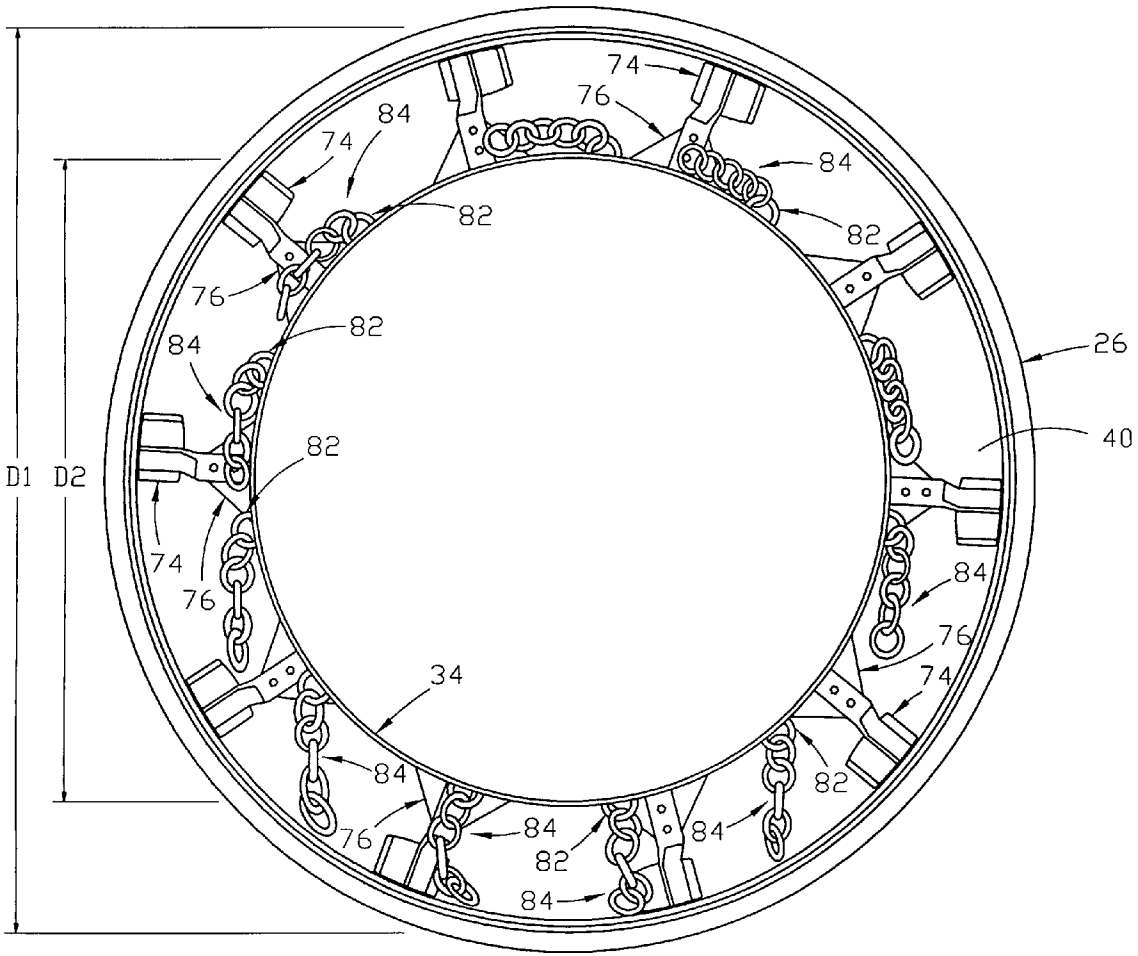
FIG. 2 illustrates a partial sectional view of the asphalt dryer/mixer of FIG. 1, taken along line 2-2 of FIG. 1.
Figure 3:
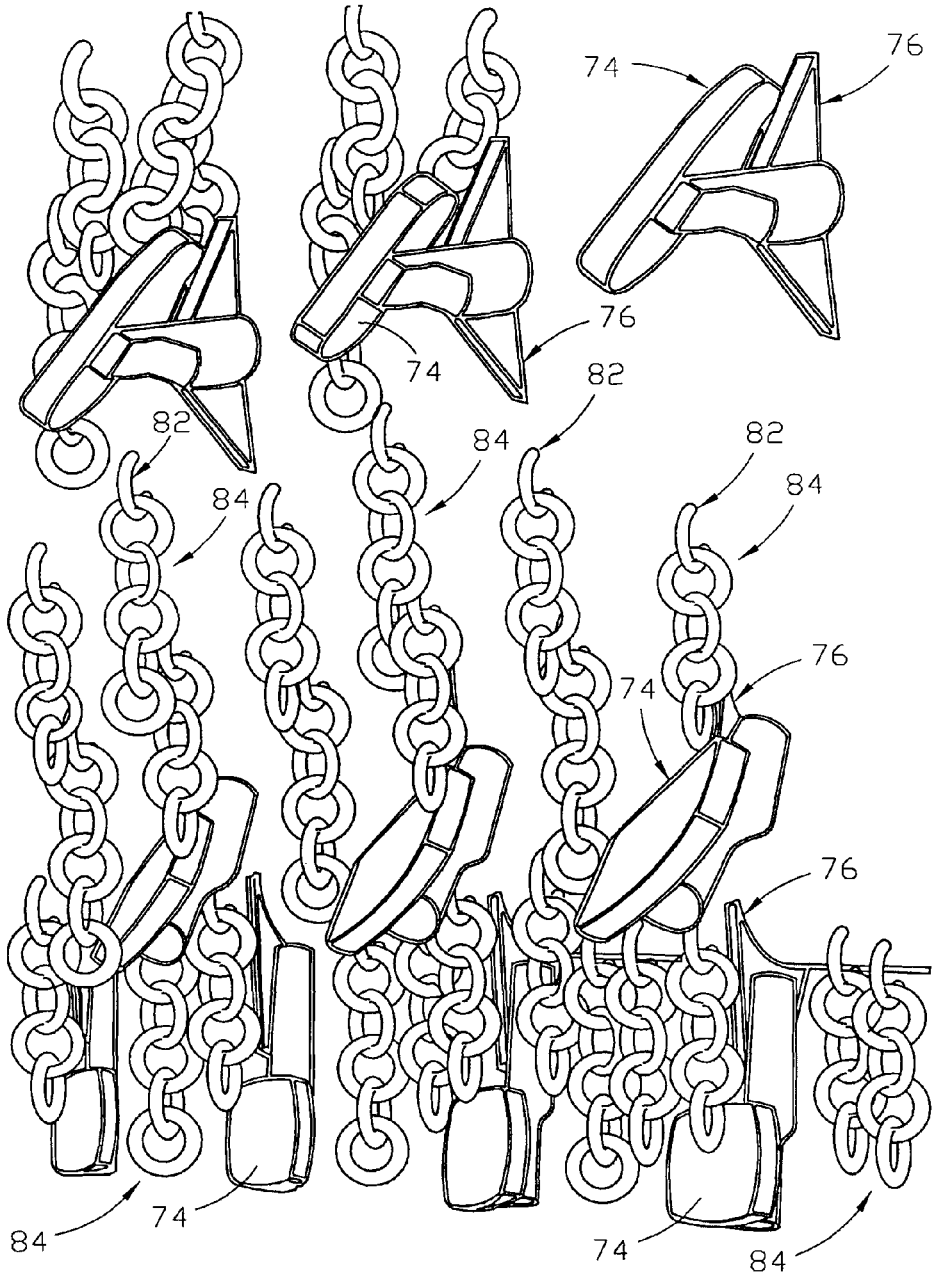
FIG. 3 is a side view of a portion of the inner drum of the asphalt dryer/mixer illustrated in FIGS. 1 and 2, showing the modification of such device by use of the first embodiment of the template to incorporate a plurality of agitation strands in the form of kiln chains.

FIGS. 1-3 illustrate a first embodiment of an asphalt dryer/mixer 20 that has been adapted by means of the invention to minimize the build-up of asphalt cement and asphalt concrete on the outer surface of the inner drum. As can be seen in FIG. 1, asphalt dryer/mixer 20 is a counter-flow dryer/mixer such as is sold by Astec Inc. of Chattanooga, Tenn. under the trademark DOUBLE BARREL. Although asphalt dryer/mixer 20 is of a counter-flow design, the invention may be employed with respect to any asphalt dryer/mixer that includes a fixed outer drum and a rotatable inner drum mounted with respect to the outer drum so as to form an annular mixing chamber between the outer surface of the inner drum and the inner surface of the outer drum in which asphalt cement and aggregate materials are mixed.

Dryer/mixer 20 is supported on a frame 24 and includes a generally cylindrical fixed outer drum 26 having a longitudinal axis 28 that is inclined with respect to the horizontal so that the outer drum has an upper end 30 and a lower end 32. Dryer/mixer 20 also includes a heating/drying chamber comprised of a generally cylindrical, hollow inner drum 34 having a longitudinal axis that is coincident with longitudinal axis 28 of the fixed outer drum.

Outer drum 26 has an inside diameter $D_1$ (shown in FIG. 2) that is greater than the outside diameter $D_2$ of inner drum 34. Furthermore, since the longitudinal axis of inner drum 34 is coincident with axis 28 of outer drum 26, inner drum 34 is inclined at the same angle with respect to the horizontal as outer drum 26, so that inner drum 34 has an upper end 36 and a lower end 38. The angle at which the dryer/mixer is operated and transported may be fixed or it may be capable of adjustment by means of a hydraulic lift (not shown) or other means known to those having ordinary skill in the art to which the invention relates. By increasing or decreasing the angle at which the dryer/mixer is operated, the amount of time that aggregate material spends in the dryer/mixer may be decreased or increased, respectively, thereby allowing the operator to control the production process to some degree without changing in the rate of rotation of the inner drum with respect to the outer drum.

Because inside diameter $D_1$ of outer drum 26 is greater than outside diameter $D_2$ of inner drum 34, an annular mixing chamber 40 is provided between the outer drum and the inner drum. Outer drum 26 is fixedly mounted to the frame 24 on a plurality of supports 42 and encircles at least a portion of inner drum 34. Inner drum 34 is rotatably mounted on the frame 24 by means of bearings 44 mounted to the frame which engage races 46 located on the circumference of the drum. A motor 48 is adapted to rotatably drive a drive sprocket (not shown, but located in housing 50) that is in driving engagement with a chain drive (not shown, but located in housing 52 on the outer surface of the inner drum) to rotate drum 34 in a conventional manner. Alternative drive systems such as are known to those having ordinary skill in the art to which the invention relates may also be employed to rotate inner drum 34 with respect to fixed outer drum 26.

At upper end 36 of inner drum 34, chute 54 provides for introduction of aggregate materials through inlet 56 into the inner drum. Due to the inclination and rotation of the inner drum, the aggregate materials will be conveyed from inlet 56 towards lower end 38 of the drum. Dryer/mixer 20 also includes a burner 58 at lower end 38 which is adapted to heat and dry the aggregate material within inner drum 34. As shown in FIG. 1, burner 58 is adapted to direct a flame 60 into the interior of the inner drum. Typical fuels that are burned in the burner include oil, natural gas, LP gas, and pulverized coal. Fan 62 is used to introduce a mixture of fuel and air into the burner, where the mixture is ignited to produce the flame and gases of combustion that heat and dry the aggregate materials which pass through the interior of the inner drum. As inner drum 34 rotates with respect to outer drum 26, a plurality of inner mixing paddles (not shown) mounted on the inner surface of the inner drum lift and tumble the aggregate materials in the inner drum, thereby enabling a more thorough heating and drying of the aggregate materials as they are passed through the heated gases flowing through the drum. An exhaust fan (not shown) may also be employed in combination with burner 58 to direct a flow of exhaust gases and dust from lower end 38 of drum 34, through the drum, and out upper end 36. The exhaust gases of combustion and entrained aggregate dust are directed out of the upper end 36 of the drum 34 through plenum 64 and outlet 66 to a conventional dust filtering device (not shown), such as a baghouse, cyclone separator, or wet-wash system.

Inner drum 34 is provided with an outlet 70, preferably comprised of a plurality of openings in the drum wall, at or near its lower end 38, for discharge of heated aggregate materials into annular mixing chamber 40. Asphalt cement supply line 72 provides for introduction of asphalt cement from a suitable source (not shown) through an AC inlet (also not shown) into annular mixing chamber 40. Inner drum 34 is preferably made of heat-conductive material so that a portion of the heat generated by burner 58 is transferred to the annular mixing chamber. A plurality of mixing paddles 74 are mounted on paddle mounting plates 76 which are affixed to the outer surface of inner drum 34 (some of which are omitted, for clarity, in FIG. 1). As shown in FIG. 2, these mixing paddles are arranged so that, as inner drum 34 rotates, the mixing paddles span substantially the entire radial distance between the outer surface of inner drum 34 and the inner surface of outer drum 26. Mixing paddles 74 are also preferably angled in such a manner that in addition to mixing the aggregate materials and asphalt cement in the mixing chamber, the mixing paddles convey the resulting asphalt concrete mixture to discharge paddles 78 (see FIG. 4), which are aligned with outlet 80 of the annular mixing chamber that is provided through outer drum 26 at or near its upper end 30. The asphalt concrete paving material may then be discharged from annular mixing chamber 40 through outlet 80.

The invention comprises a method for modifying an asphalt dryer/mixer such as is shown in FIGS. 1-3 in order to minimize the build-up of asphalt cement and asphalt concrete materials on the outer surface of the inner drum. The invention includes providing a template (described in more detail hereinafter) that is used to locate brackets 82 on the outer surface of the inner drum to which agitation strands 84 may be attached. As shown in FIGS. 2 and 3, one embodiment of bracket 82 comprises a half-link of a kiln chain. When this embodiment of the bracket is employed, it is preferred that bracket 82 comprise a generally circular chain link having a diameter within the range of 3-4 inches. It is also preferred that each agitation strand is provided in the form of a section of kiln chain, most preferably comprising generally circular links of the same diameter as the bracket half-link. As will be discussed in more detail hereinafter, it is also preferred that the brackets be placed around the mixing paddles on the outer surface of the inner drum between the approximate location of the AC inlet into the mixing chamber and discharge paddles 78 on or near the upper end of the inner drum. Preferably, each agitation strand 84 has a length, when attached to the bracket, within the range of 75-100% of the radial distance between the outer surface of the inner drum and the inner surface of the outer drum.

In the preferred embodiments of the invention illustrated in the drawings, one end of each agitation strand is attached to a bracket, and the other end is free, so that the agitation strand will move around on the outer surface of the inner drum as the drum rotates with respect to the outer drum. FIG. 2 illustrates possible configurations for various agitation strands during rotation, depending on their location on the outer surface of the inner drum. It is believed that the movement of the agitation strands during rotation disturbs or agitates the asphalt cement and other material on the outer surface of the inner drum so that build-up is avoided.

Figure 4:
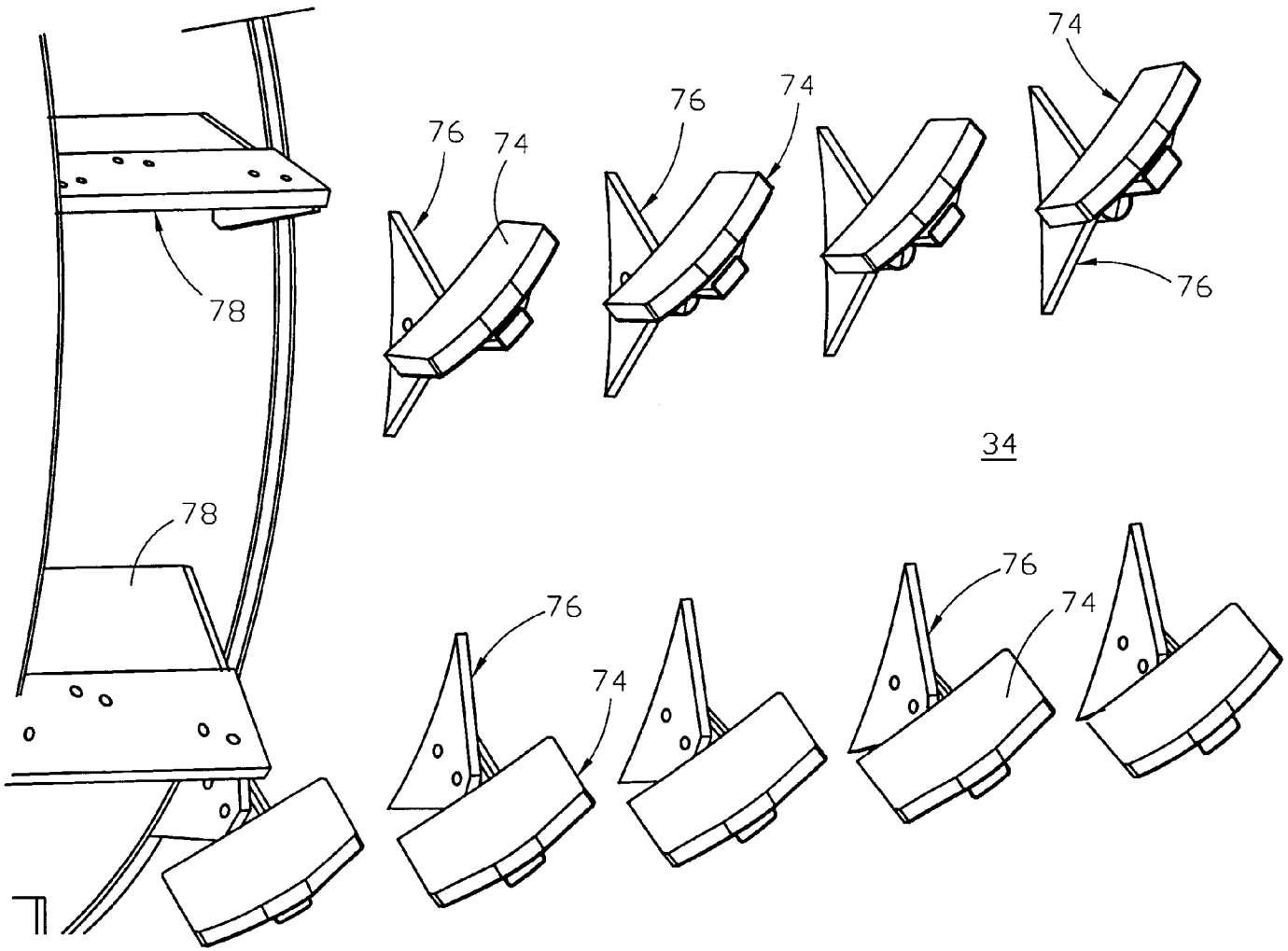
FIG. 4 is a perspective view of a portion of the inner drum to the asphalt dryer/mixer of FIGS. 1-3, showing the mixing paddles which are mounted on the inner drum for clockwise rotation.
Figure 5:
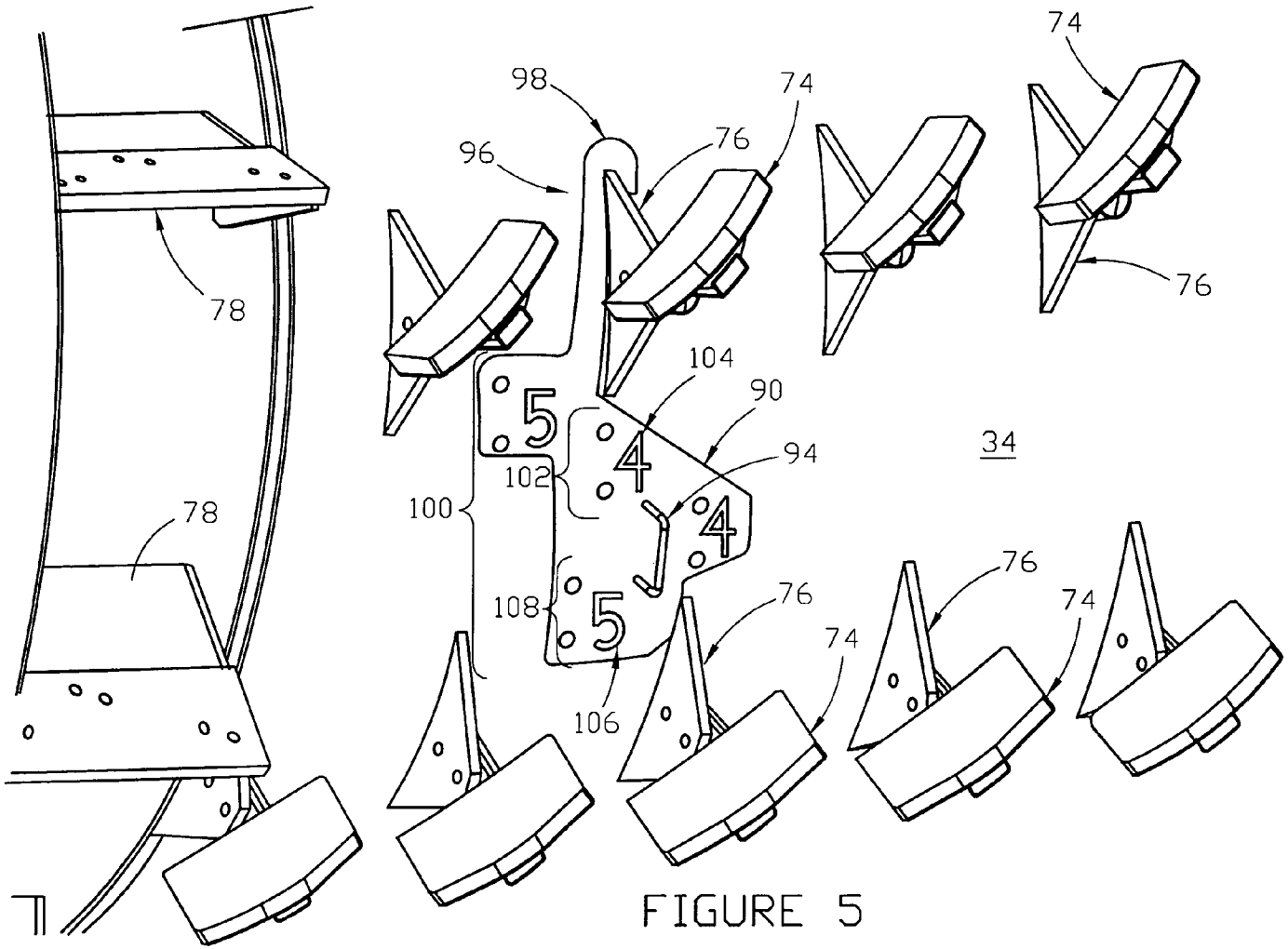
FIG. 5 is a view similar to that of FIG. 4, showing the orientation of a first embodiment of a template with respect to mixing paddles which are mounted on the inner drum.
Figure 6:
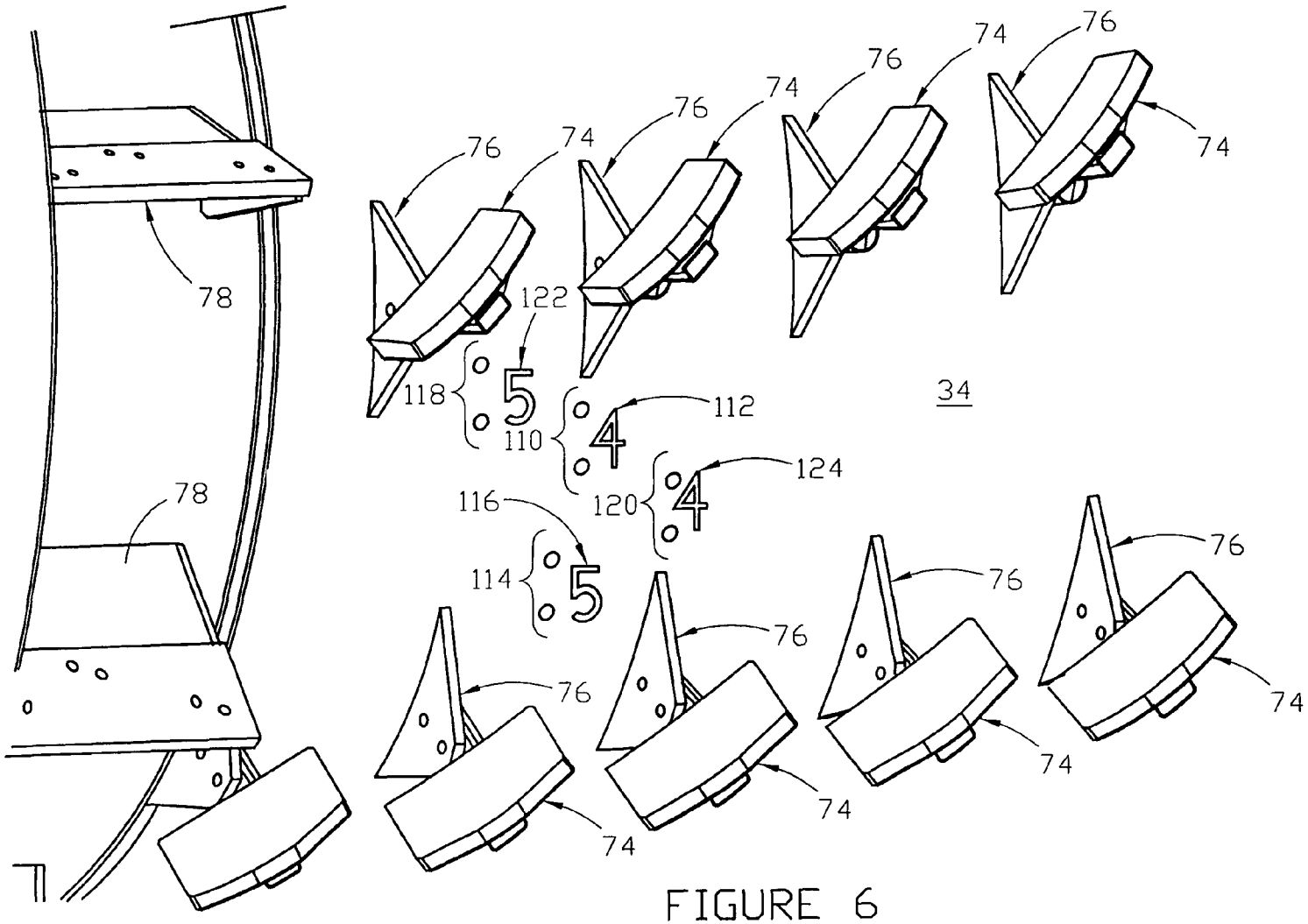
FIG. 6 is a view similar to that of FIGS. 4 and 5, showing the markings obtained by a use of the first embodiment of the template illustrated in FIG. 5.
Figure 7:
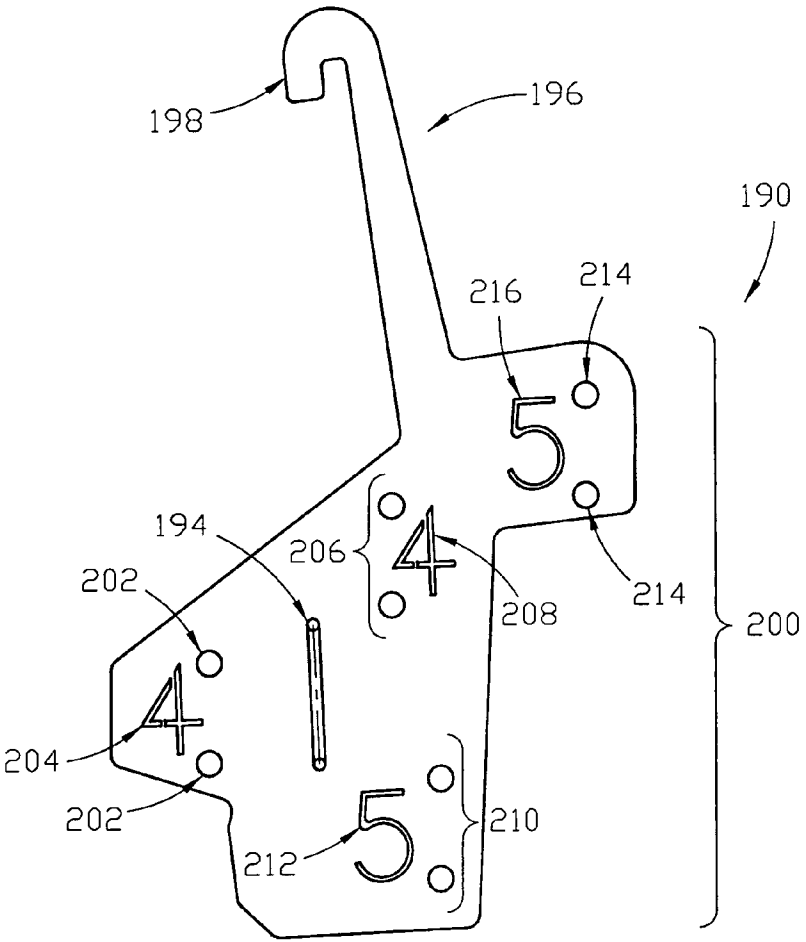
FIG. 7 is front view of a second embodiment of a template according to the invention, which is intended for use in connection with an inner drum having mixing paddles that are mounted for counter-clockwise rotation.
Figure 8:
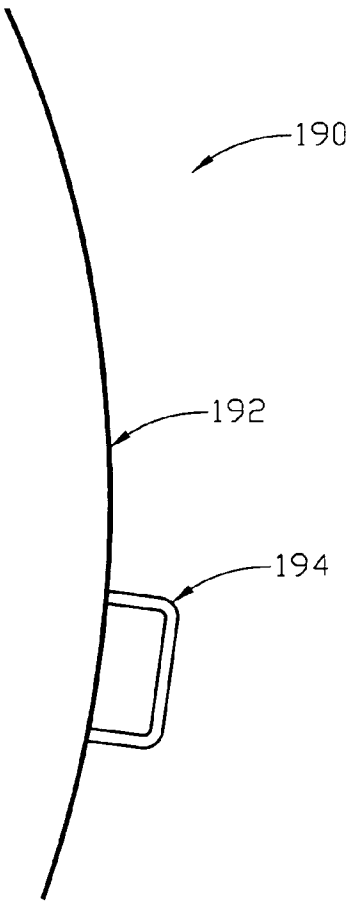
FIG. 8 is a side view of the template of FIG. 7.
Figure 9:
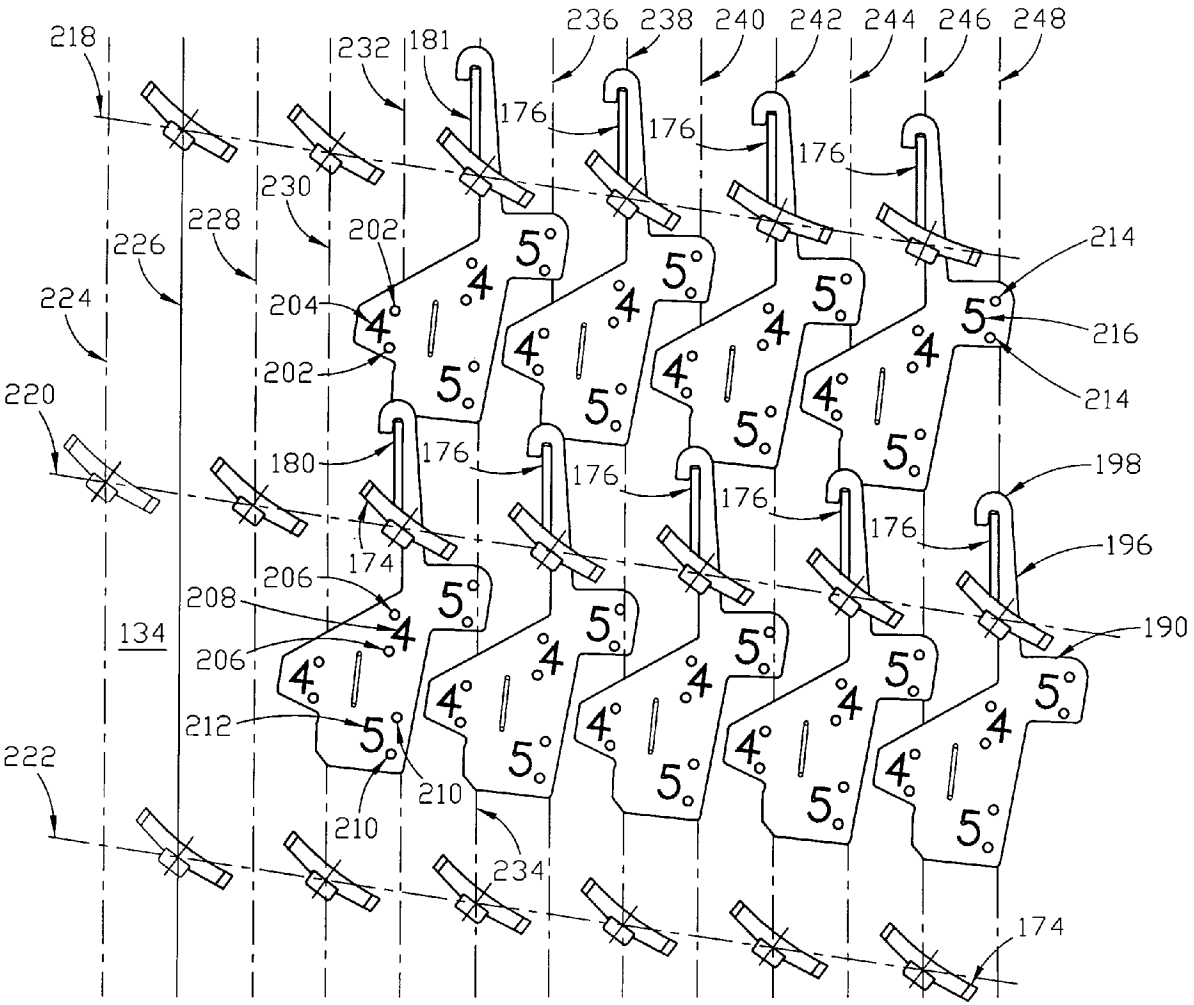
FIG. 9 is a side view of a portion of an inner drum of an asphalt dryer/mixer having mixing paddles that are mounted for counter-clockwise rotation, showing how the second embodiment of the template can be used to locate brackets with respect to adjacent mixing paddles.

FIGS. 4-6 illustrate a portion of inner drum 34 of asphalt dryer/mixer 20 between the location of the AC inlet for introducing asphalt cement into the mixing chamber (not shown) and discharge paddles 78. As shown therein, each of mixing paddles 74 is mounted on paddle mounting plate 76, which in turn is mounted on the outer surface of the inner drum. The mixing paddles for asphalt dryer/mixer 20 are oriented for clockwise rotation of the drum. First embodiment 90 of a template (shown in FIG. 5) may be used according to the invention to modify asphalt dryer/mixer 20 to minimize the production of asphalt build-up on the outer surface of the inner drum. FIGS. 7-9 illustrate second embodiment 190 of a template that may be used according to the invention to modify an asphalt dryer/mixer that is similar to dryer/mixer 20 except that the inner drum is adapted for counter-clockwise rotation.

As best shown in FIG. 8, template 190 comprises a plate 192 that is curved so as to overlie a portion of the outer surface of the inner drum. Template 90 (shown in FIGS. 4-6) is similarly curved (although such curvature is not shown in the drawings). As will be appreciated by those having ordinary skill in the art to which the invention relates, the curvature of the template is selected to correspond to the curvature of the outer surface of the inner drum. Template 190 is curved to correspond to inner drum 134 (similar to inner drum 34 of dryer/mixer 20, except that mixing paddles 174 mounted on paddle mounting plates 176 are mounted for counter-clockwise rotation). Plate 192 of template 190 is curved to correspond to an outer diameter of drum 134 (similar to diameter D2 of drum 34 shown in FIG. 2) of eight feet. Attached to curved plate 192 of template 190 is supporting handle 194, which may be gripped by a user of the template to hold it in place on the surface of the inner drum during the marking process.

Referring again to FIG. 5, template 90 includes paddle reference portion 96, preferably comprising hook 98, that is adapted to locate bracket marking portion 100 with respect to a selected mixing paddle by hanging on paddle mounting plate 76 of the selected mixing paddle. Supporting handle 94 may be used to hold the template against the outer surface of the inner drum during the marking process. Bracket marking portion 100 is adapted to locate one or more brackets on the outer surface of the inner drum. Preferably, the bracket marking portion comprises as a bracket locator a plurality of pairs of holes, such as pair 102, that may be used to mark points at which kiln chain half-link brackets may be welded to the outer surface of the inner drum. In addition, the preferred bracket marking portion is also adapted to associate with each bracket located on the outer surface of the inner drum a length indicator to identify the length of the agitation strand to be attached thereto. In the preferred embodiment of the invention, bracket marking portion 100 includes a plurality of length indicators, each of which comprises a numerical outline or stencil of a number that is indicative of the number of links of a kiln chain to be attached to the bracket to be located by said pair of holes. Thus, for example, numerical outline 104 is associated with pair 102 of bracket marking holes, and numerical outline 106 is associated with pair 108 of bracket marking holes on bracket marking portion 100. Preferably, the template is mounted over a paddle mounting plate 76 as shown in FIG. 5, and paint or another marking substance is sprayed over the holes and numerical outlines in the bracket marking portion, thereby producing the pattern shown in FIG. 6. By spraying paint over pair 102 of holes in the bracket marking portion of template 90 and its associated numerical outline 104, marking points 110 and numeral 112 will be produced on the surface of the inner drum. This indicates that a half-link kiln chain bracket is to be welded into place on points 110, and that an agitation strand comprising four links of a kiln chain is to be attached to this bracket. Similarly, the spraying of paint over pair 108 of holes in template 90 and its associated numerical outline 106 will produce marked points 114 and numeral 116 on the inner drum. This indicates that a half-link kiln chain bracket is to be welded into place on points 114, and that an agitation strand comprising five links of a kiln chain is to be attached to this bracket. Points 118 and 120, along with corresponding numerical outlines 122 and 124, respectively, may also be produced on the inner drum by a use of template 90 as shown in FIGS. 5 and 6. These markings indicate that half-link kiln chain brackets are to be welded or otherwise attached onto the outer surface of drum 34 at points 118 and 120, with kiln chains having five and four links, respectively, attached thereto. Those having ordinary skill in the art to which the invention relates will appreciate that other methods of marking the outer surface of the inner drum may be used, and that length indicators of other types, such as those indicating an actual length of the agitation strand to be attached, may be employed within the scope of the invention.

Referring again to FIGS. 7-9, the use of a second embodiment 190 of the preferred template in connection with the invention is illustrated. FIG. 9 illustrates a portion of inner drum 134, to which is attached a plurality of paddle mounting plates 176 and associated mixing paddles 174. As described above, the mixing paddles on drum 134 are oriented for counter-clockwise rotation of the inner drum. FIG. 9 shows how template 190 can be associated serially with each of a plurality of mixing paddles 174 on drum 134. As shown in FIGS. 7-9, template 190 includes paddle reference portion 196, preferably comprising hook 198, that is adapted to locate bracket marking portion 200 with respect to a selected mixing paddle by hanging on paddle mounting plate 176 of the selected mixing paddle. Bracket marking portion 200, comprising a plurality of pairs of holes, is adapted to locate a plurality of brackets on the outer surface of inner drum 134 by marking points at which kiln chain half-link brackets may be welded to the outer surface of the inner drum. In addition, bracket marking portion 200, like bracket marking portion 100 of template 90, is also adapted to associate with each bracket located on the outer surface of the inner drum a length indicator comprising a numerical outline indicative of the number of links of a kiln chain to be attached to the adjacent bracket.

Referring again to FIG. 7, bracket marking portion 200 includes pair 202 of holes and associated numerical outline 204, pair 206 of holes and associated numerical outline 208, pair 210 of holes and associated numerical outline 212 and pair 214 of holes and associated numerical outline 216. In this embodiment of the invention, each pair of holes is spaced to accommodate a kiln chain half-link having a diameter of about four inches. Furthermore, numerical outline 204 indicates that an agitation strand comprising a four link section of kiln chain is associated with holes 202. Similarly, numerical outline 208 indicates that an agitation strand comprising a four link section of kiln chain is associated with holes 206. Numerical outline 212 indicates that an agitation strand comprising a five link section of kiln chain is associated with holes 210, and numerical outline 216 indicates that an agitation strand comprising a five link section of kiln chain is associated with holes 214.

As shown in FIG. 9, a plurality of paddle mounting plates 176, 180 and 181 are mounted on the outer surface of inner drum 134 on and along a plurality of longitudinal lines 218, 220 and 222, and a plurality of circumferential lines 224, 226, 228, 230, 232, 234, 236, 238, 240, 242, 244, 246 and 248. Circumferential line 232 (fifth from the left, as shown in FIG. 9) is the one that is generally aligned with the AC inlet into the mixing chamber between inner drum 134 and its associated outer drum. Paddle mounting plate 180 (which is essentially identical to paddle mounting plates 176 and 181) is the one that is located on circumferential line 232. It has been found unnecessary to locate brackets on the downhill side (i.e. the side nearest the burner) of the AC inlet on the inner drum. Consequently, when template 190 is placed over paddle mounting plate 180 on circumferential line 232, it is not necessary to mark a location for brackets using holes 202 and numerical indicator 204. However, it is preferred to mark a location for brackets using holes 206, 210 and 214 and corresponding numerical indicators 208, 212 and 216, respectively. The entire template is preferably used for marking the outer surface of the inner drum for all mixing paddles mounted on paddle mounting plates between circumferential line 232 and the discharge paddles (not shown in FIG. 9, but substantially similar to discharge paddles 78 of drum 34).

As mentioned above, paddle mounting plate 181 is essentially identical to paddle mounting plates 176 and 180, except that it is located on circumferential line 234 (sixth from the left as viewed in FIG. 9). The preferred arrangement of brackets can be determined, by examining FIG. 9. Consequently, except for the markings made with reference to the mixing paddles that are mounted on paddle mounting plates on circumferential line 232, bracket marking portion 200 of template 190 is sized and configured to locate a pair of brackets adjacent to the selected mixing paddle and approximately on the circumferential line for the paddle mounting plate of the selected mixing paddle, and to locate a pair of brackets adjacent to the selected mixing paddle, each of which is approximately on one of the circumferential lines adjacent to the circumferential line for the paddle mounting plate of the selected mixing paddle. In other words, when hook 198 of template 190 is hanged on paddle mounting plate 181, the bracket mounting portion may be used to mark bracket locations using hole pairs 206 and 210 on circumferential line 234 (on which the paddle mounting plate is located), and to mark bracket locations using hole pair 202 on circumferential line 232 (to the left of and adjacent to circumferential line 234, as viewed in FIG. 9), and to mark bracket locations using hole pair 214 on circumferential line 236 (to the right of and adjacent to circumferential line 234, as viewed in FIG. 9).

As mentioned above, bracket marking portion 200 of template 190 is adapted to associate with each bracket located on the outer surface of the inner drum a length indicator comprising a numerical outline indicative of the number of links of a kiln chain to be attached to the adjacent bracket. By viewing FIG. 9, it can be seen that when the bracket marking portion of preferred template 190 is used to locate a pair of brackets adjacent to the selected mixing paddle and approximately on the circumferential line for the paddle mounting plate associated with such mixing paddle, the numerical indicators associated with such hole pairs will indicate that a shorter agitation strand be attached to the bracket nearer to the selected mixing paddle than to the one further away. By way of example, when the template on paddle mounting plate 181 is used to locate brackets using hole pairs 206 and 210, numerical indicator 208 which is associated with nearer holes 206 indicates that a four-link chain be attached to the bracket mounted at that location, while numerical indicator 212 which is associated with more distant holes 210 indicates that a five-link chain is to be attached to the bracket mounted at the more distant location.

Figure 10:
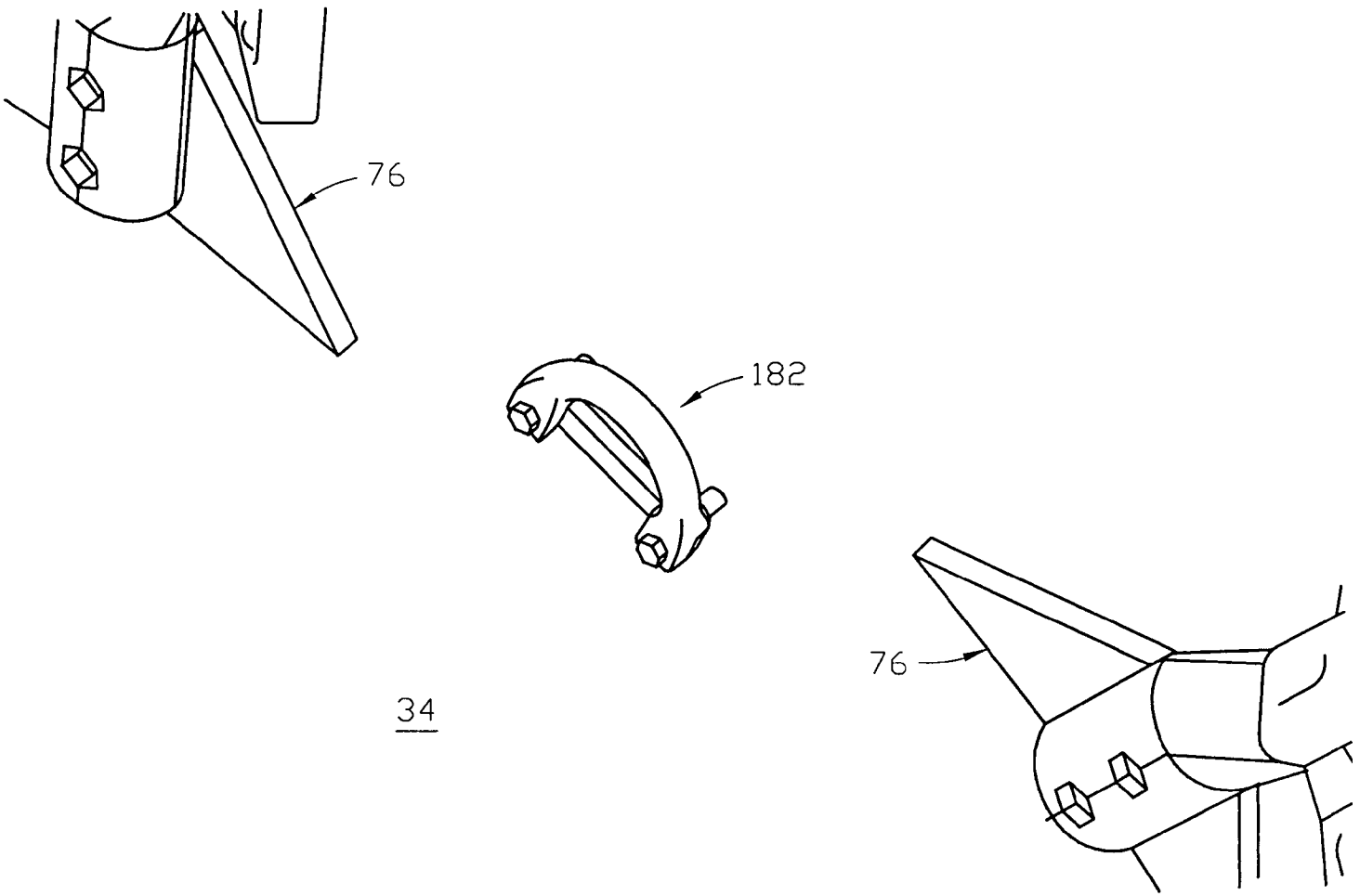
FIG. 10 is a side view of a portion of an inner drum of an asphalt dryer/mixer such as is shown in FIG. 4, showing an alternative embodiment of a bracket assembly to which an agitation strand may be attached.
Figure 11:
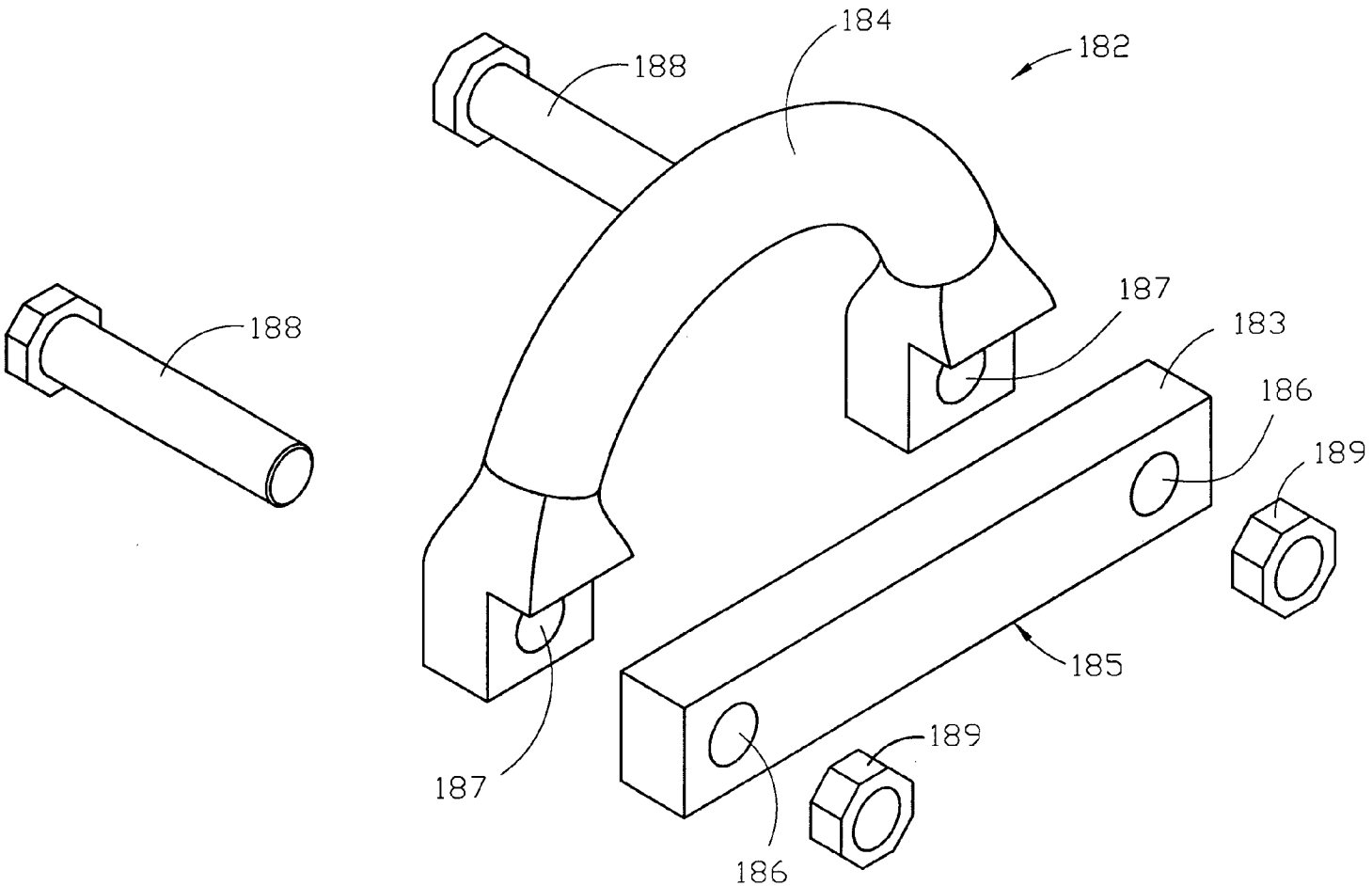
FIG. 11 is an exploded view of the bracket assembly of FIG. 10.

FIGS. 10 and 11 illustrate a second embodiment of a bracket that may be affixed to the outer surface of the inner drum to which an agitation strand such as agitation strand 84 may be attached. As shown therein, bracket 182 comprises an assembly including attachment bar 183 and replaceable bracket component 184. In the embodiment illustrated in the drawings, the attachment bar has a lower surface 185 that is curved to match the curvature of drum 34, so that the attachment bar can be securely welded to the surface of the drum. Attachment bar 183 also includes a pair of holes 186 that may be aligned with holes 187 in bracket component 184. Prior to attaching the bracket component to the attachment bar using bolts 188 and nuts 189, an agitation strand, preferably comprising a section of kiln chain, most preferably comprising a section of kiln chain having generally circular links, may be slipped over one end of the bracket component. By using bolts 188 and nuts 189 or other fasteners to removably attach the bracket component to the attachment bar, the bracket component and/or the agitation strand may be easily replaced if damaged or broken during use.

Holes 186 of attachment bar 183 are preferably spaced to correspond to the spacing of each pair of holes on bracket marking portion 100 of template 90 or on bracket marking portion 200 of template 190. In the alternative, the attachment bar could be marked by paint dots that are spaced to correspond to the pairs of holes in template 90 or template 190, or it could be marked in other ways to correspond to the markings or indicators of a bracket marking portion of another template constructed according to the invention.

If, as is preferred, holes 186 of attachment bar 183 are spaced to correspond to the spacing of each pair of holes on bracket marking portion 100 of template 90 or on bracket marking portion 200 of template 190, the template (either template 90 or template 190, as applicable) may be used to locate its associated bracket marking portion with respect to a selected mixing paddle by hanging the template hook on paddle mounting plate of the selected mixing paddle. The supporting handle associated with the template may then be used to hold the template against the outer surface of the inner drum so that paint or another marking material may be sprayed through the pairs of holes on the bracket marking portion to locate one or more brackets on the outer surface of the inner drum.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A method for modifying an asphalt dryer/mixer comprising:

(1) a stationary outer drum having an inner surface;

(2) a rotatable inner drum having an outer surface with a plurality of mixing paddles mounted thereon;

wherein the inner drum is mounted within the outer drum so as to form an annular mixing chamber between the outer surface of the inner drum and the inner surface of the outer drum in which asphalt cement and aggregate materials are mixed, said method comprising:

(a) providing a template that is curved so as to overlie a portion of the outer surface of the inner drum, said template comprising:
  (i) a bracket marking portion that is adapted to locate one or more brackets on the outer surface of the inner drum;
  (ii) a paddle reference portion that is adapted to locate the bracket marking portion with respect to a mixing paddle;
(b) selecting a mixing paddle to be referenced for locating a bracket;
(c) placing the template on the outer surface of the inner drum with the paddle reference portion referencing the selected mixing paddle;
(d) providing a bracket;
(e) using the template to mark the location of the bracket;
(f) affixing the bracket to the outer surface of the inner drum at the bracket location marked;
(g) providing an agitation strand that is adapted to be attached to the bracket;
(h) attaching the agitation strand to the bracket.

2. The method of claim 1 wherein the agitation strand has a length, when attached to the bracket, within the range of 75-100% of the radial distance between the outer surface of the inner drum and the inner surface of the outer drum.

3. The method of claim 1 wherein the bracket marking portion of the template is adapted to associate with each bracket located on the outer surface of the inner drum a length indicator to identify the length of the agitation strand to be attached thereto.

4. The method of claim 1 which includes providing a template with the bracket marking portion comprising a pair of holes to mark points at which the bracket may be attached to the outer surface of the inner drum.

5. The method of claim 4 which includes using the template to mark the location of a bracket by spraying paint over the holes in the template.

6. The method of claim 4 which includes providing the bracket in the form of a half-link of a kiln chain.

7. The method of claim 4 which includes providing the bracket in the form of an assembly comprising an attachment bar that is adapted to be welded to the outer surface of the inner drum, and a bracket component that is adapted to be removably attached to the attachment bar.

8. The method of claim 4 which includes providing the agitation strand in the form of a section of kiln chain.

9. The method of claim 8 wherein the kiln chain comprises a plurality of generally circular links.

10. The method of claim 1 for use in connection with an asphalt dryer/mixer having a plurality of paddle mounting plates mounted on the outer surface of the inner drum and a mixing paddle mounted on each paddle mounting plate, wherein the paddle reference portion of the template comprises a hook that is adapted to hang on the paddle mounting plate of the selected paddle.

11. The method of claim 1 for use in connection with an asphalt dryer/mixer having:

(1) a plurality of paddle mounting plates mounted on the outer surface of the inner drum, said paddle mounting plates being mounted on and along a plurality of longitudinal lines and a plurality of circumferential lines; and
(2) a mixing paddle mounted on each paddle mounting plate;

wherein:

(a) the bracket marking portion of the template is adapted to locate a plurality of brackets on the outer surface of the inner drum; and
(b) the paddle reference portion of the template comprises a hook that is adapted to hang on the paddle mounting plate of the selected mixing paddle.

12. The method of claim 11:

wherein the bracket marking portion of the template is sized and configured to locate a pair of brackets adjacent to the selected mixing paddle and approximately on the circumferential line for the paddle mounting plate associated with such mixing paddle, one of which brackets is nearer to the selected mixing paddle than the other;

(a) which includes attaching a shorter agitation strand to the bracket that is nearer the selected mixing paddle than to the bracket that is further away from the mixing paddle.

13. The method of claim 11 wherein the bracket marking portion of the template is sized and configured to locate a pair of brackets on circumferential lines adjacent to and on opposite sides of the circumferential line for the paddle mounting plate associated with the selected mixing paddle.

14. A template for use in modifying an asphalt dryer/mixer comprising a rotatable inner drum having an inner drum radius and an outer surface with a plurality of mixing paddles, each of which is mounted on a paddle mounting plate that is affixed to the outer surface of the inner drum, and a stationary outer drum having an inner surface, wherein the inner drum is mounted within the outer drum so as to form an annular mixing chamber between the outer surface of the inner drum and the inner surface of the outer drum in which asphalt cement and aggregate materials are mixed, said template comprising a plate that is curved so as to overlie a portion of the outer surface of the inner drum, said plate comprising:

(a) a bracket marking portion that is adapted to locate one or more brackets on the outer surface of the inner drum, wherein each such bracket is adapted to attach to an agitation strand;
(b) a paddle reference portion that is adapted to locate the bracket marking portion with respect to a selected mixing paddle.

15. The template of claim 14 which includes a supporting handle.

16. The template of claim 14 wherein the paddle reference portion comprises a hook that is adapted to hang on the paddle mounting plate of the selected mixing paddle.

17. The template of claim 14 wherein the bracket marking portion includes a length indicator marker to identify the length of the agitation strand to be attached to each bracket located on the outer surface of the inner drum by use of the template.

18. The template of claim 14 wherein the bracket marking portion comprises a pair of holes to mark points at which the bracket may be attached to the outer surface of the inner drum.

19. The template of claim 18 wherein the pair of holes are spaced so as to accommodate a bracket comprising a half-link of a kiln chain.

20. The template of claim 14 wherein the bracket marking portion is adapted to locate a bracket comprising an assembly including an attachment bar that is adapted to be welded to the outer surface of the inner drum and a bracket component that is adapted to be removably attached to the attachment bar.

21. The template of claim 14 wherein the bracket marking portion includes a locator for each bracket to be located thereby and a numerical outline adjacent to each locator that is indicative of the number of links of a kiln chain to be attached to the bracket to be located by each such locator.

22. The template of claim 21 wherein:

(a) the paddle reference portion comprises a hook that is adapted to hang on the paddle mounting plate of the selected mixing paddle;

(b) the bracket marking portion is sized and configured to locate a pair of brackets adjacent to the selected mixing paddle and approximately on the circumferential line for the paddle mounting plate of the selected mixing paddle;

(c) the bracket marking portion is sized and configured to locate a pair of brackets adjacent to the selected mixing paddle, each of which is approximately on one of the circumferential lines adjacent to the circumferential line for the paddle mounting plate of the selected mixing paddle.

* * * * *